US005702595A

United States Patent [19]

Mossburg, Jr.

[11] Patent Number: 5,702,595

[45] Date of Patent: Dec. 30, 1997

[54] CATCH BASIN GUARD

[76] Inventor: William H. Mossburg, Jr., 308 Carr Ave., Rockville, Md. 20850

[21] Appl. No.: 761,609

[22] Filed: Dec. 6, 1996

Related U.S. Application Data

[60] Provisional application No. 60/009,026, Dec. 21, 1995.

[51] Int. Cl.[6] ..... E01F 5/00

[52] U.S. Cl. ..... 210/163; 210/232; 404/4

[58] Field of Search ..... 210/162, 163, 210/164, 165, 166, 232, 460; 404/2, 3, 4, 5

[56] References Cited

U.S. PATENT DOCUMENTS

| | | | |
|---|---|---|---|
| 232,948 | 5/1880 | Dernham . | |
| 672,868 | 4/1901 | Banwell . | |
| 4,594,157 | 6/1986 | McGowan . | |
| 4,610,566 | 9/1986 | Albang et al. | 404/4 |
| 5,284,580 | 2/1994 | Shyh . | |
| 5,345,741 | 9/1994 | Slater et al. . | |
| 5,582,720 | 12/1996 | Deming | 210/164 |

FOREIGN PATENT DOCUMENTS

| | | |
|---|---|---|
| 9523B/33 | 6/1979 | German Dem. Rep. . |
| 1194-984-A | 11/1985 | U.S.S.R. . |
| 273060 | 6/1927 | United Kingdom . |

*Primary Examiner*—Peter A. Hruskoci
*Assistant Examiner*—Theodore M. Green
*Attorney, Agent, or Firm*—Richard C. Litman

[57] ABSTRACT

The invention relates to a catch basin face cover for preventing entry into a catch basin and subsequently a storm drain. The preferred embodiment provides a form fitting cover for catch basins being installed in new construction. Newly constructed catch basins are generally not connected into existing storm drains, and consequently, tend to fill with water and debris, or become home for stray animals. The present invention blocks the inlet of a catch basin deterring the entry of water, debris, animals and, most importantly, children. This deterrent increases the completion of new construction sites because the catch basin will need less cleaning and evacuating before coupling to the existing storm drain system. Once the construction is complete, the cover has preformed punch-outs that allow water entry into the storm drain but prevent solid contaminants from entering the system.

13 Claims, 3 Drawing Sheets

CATCH BASIN GUARD

CROSS-REFERENCE TO RELATED APPLICATIONS

This application claims the benefit of U.S. Provisional Application No. 60/009,026, filed Dec. 21, 1995.

BACKGROUND OF THE INVENTION

1. Field of the Invention

The present invention relates to securing a cover for blocking a catch basin to deter entry of fluid and solid materials, or animals or children.

2. Description of Prior Art

In any sort of construction work in which the earth is disturbed by any great amount, such as excavation for building foundations or altering topological grades, the use of barrier structures is required in most locations by state or local law. In recent years, it has become common to use porous plastic silt barrier sheeting either erected with wooden fence posts or by securing sheeting with rocks or stones over the inlet of a catch basin (also referred to as storm drains and culverts). Although the silt barrier retains the silt and other solid materials (e.g., debris, sticks, etc), it is unfortunate that the moisture is allowed into the catch basins. This is particularly problematic in new development construction where the catch basins have not been linked to the existing storm lines. Consequently, fluid buildup in newly installed catch basins must be removed in order to be linked to the existing storm lines.

In new developments, the job of keeping catch basins closed is often subcontracted out and the expense of both covering the catch basin entries and maintaining the same closed is extraordinarily expensive.

In addition to the fluid buildup in the catch basin, other problems such as debris, silt, and stray animals find their way into the catch basins. Even children have either fallen or voluntarily entered into newly placed catch basins presenting even greater problems for construction crews.

Many patents are the subject of preventing silt, debris, and small animals from entering the catch basins. For example, U.S. Pat. No. 5,345,741, issued to Slater et al. on Sep. 13, 1994 discloses a silt collecting attachment for catch basins. Also, U.S. Pat. No. 5,284,580, issued to Shyh on Feb. 8, 1994, discloses a refuse collecting frame positioned beneath the cover of drainage sewers. In the structure taught by either patent, fluid entry into the catch basin will be permitted. Other relevant prior references include U.S. Pat. No. 232,948 issued to Dernham on Oct. 5, 1880; U.S. Pat. No. 672,868 issued to Banwell on Apr. 23, 1901; U.S. Pat. No. 4,594,157 issued to McGowan on Jun. 10, 1986; British Patent No. 273,060 issued to Vose on Jun. 30, 1927; East German Patent No. G9523B/33 issued to Sell et. al. on Jun. 20, 1979 and U.S.S.R. Patent No. SU 1194-984-A issued to Leka on Nov. 30, 1985.

None of the above inventions and patents, taken either singly or in combination, is seen to describe the instant invention as claimed.

SUMMARY OF THE INVENTION

Accordingly, it is a principal object of the invention to provide a barrier for catch basins.

It is another object of the invention to provide a catch basin barrier for deterring the entry of fluids, solids, and animals or children into a catch basin.

It is a further object of the invention to provide a removable catch basin barrier allowing access to the catch basin.

Still another object of the invention is to provide an simple catch basin barrier that selectively allows fluid entry yet deters solids.

It is an important feature of the invention, in particular, to provide a catch basin barrier that will prevent the entry of children into the catch basin through the drain opening.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
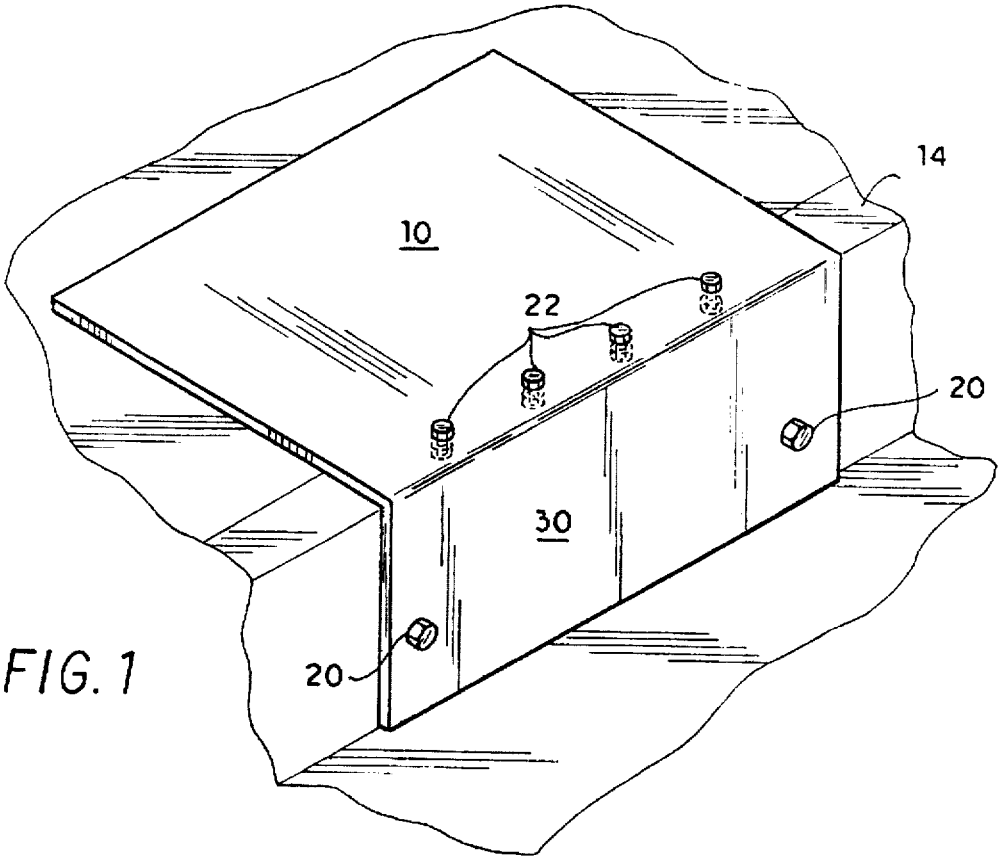
FIG. 1 is a perspective view of the catch basin barrier installed on a catch basin.
Figure 2:
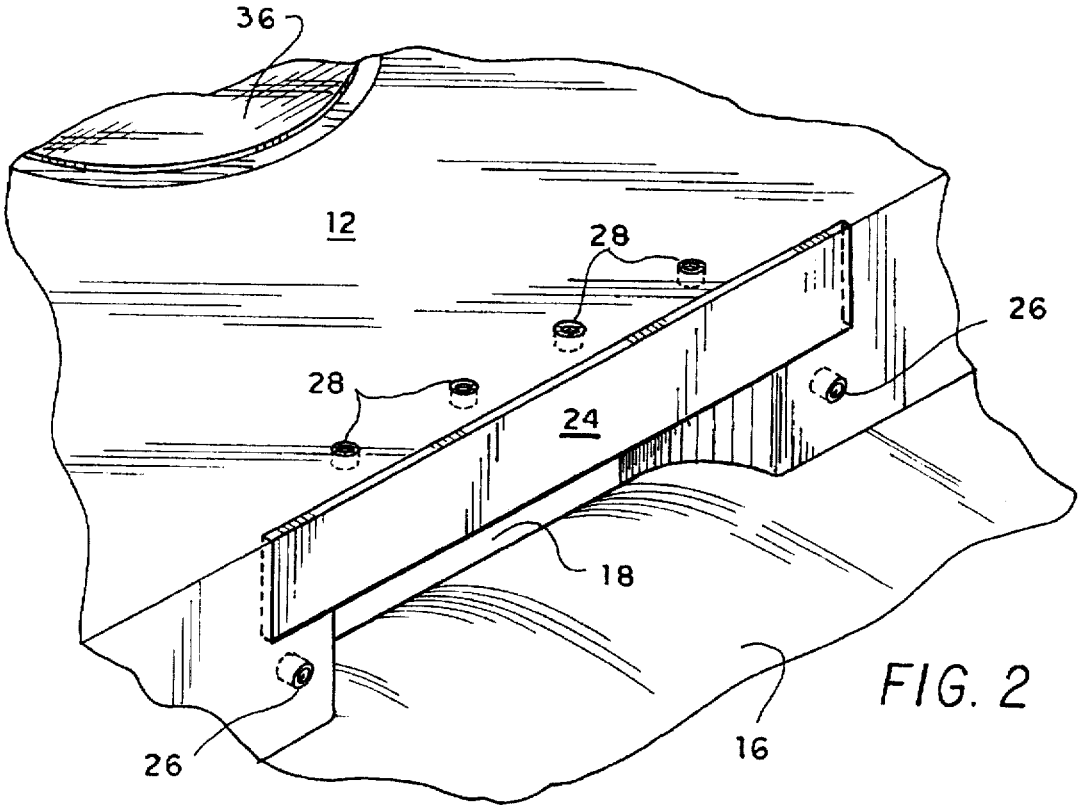
FIG. 2 is a perspective view of a catch basin having anchors seated therein.

Referring to the drawings, particularly FIGS. 1 and 2, a catch basin guard incorporating the present invention is constructed as a member 10 to cover a catch basin 12. In the preferred embodiment, the member 10 is comprised of molded plastic, although other suitable moldable material may be used. A typical catch basin 12 has an accessible manhole top 36 and an inlet 18. The catch basin guard 10 is configured to form fit a standard catch basin 12 and it is preferably wider than the inlet 18 of a catch basin 12. Specifically, the inlet 18 is covered by the face 30 of the catch basin guard 10. The catch basin guard 10 is secured to the catch basin 12 by a pair of bolts 20 coupled to a mating pair of anchors 26 in the curb 14 through the face 30 of the catch basin guard 10. The bottom edge of face 30 engages the gutter, street, or roadway (shown generally as 16) adjacent to the inlet 18, preventing unwanted fluids, solids, animals or children from entering into the catch basin 12. Additionally, the catch basin guard 10 protects against unwarranted entry into the catch basin 12 by impeding ingress to the catch basin 12 via the manhole cover 36.

Figure 3:
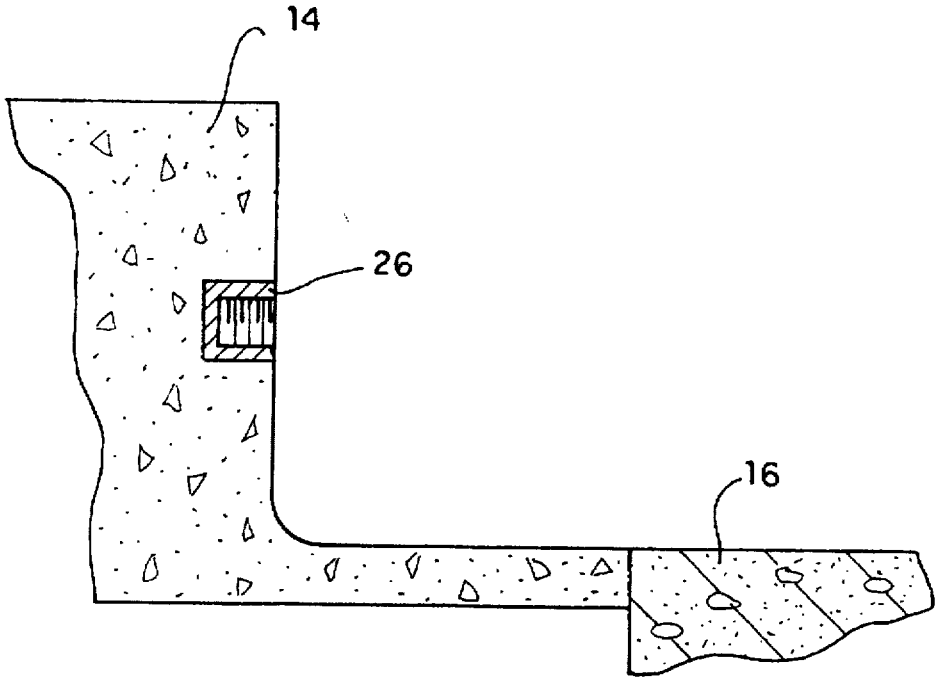
FIG. 3 is a cross-sectional view of an anchor in the curb.
Figure 4:
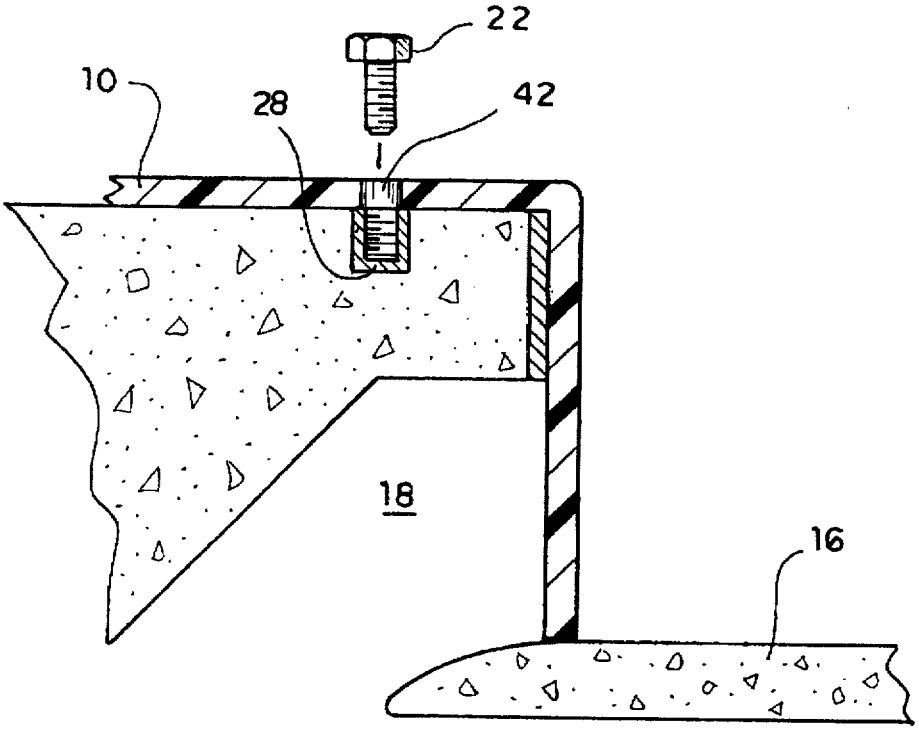
FIG. 4 is a partly exploded, cross-sectional view of structure for securing the catch basin barrier on the catch basin.

Referring to FIGS. 3 and 4, the catch basin guard 10 is optionally secured to the catch basin 12 by an additional plurality of bolts 22 along the top surface of the catch basin guard 10 or optionally along the top edge of the face 30 of the catch basin guard 10. The bolts 22 also penetrate through the catch basin guard 10 and mate with corresponding anchors 28. The anchors 26 and 28 are either fabricated in the catch basin 12 during manufacturing, or, for existing catch basins, a small bore is made and one of anchors 26 or 28 is seated in a conventional manner. In areas where the catch basin 12 is adjacent to soft soils and/or descending grades, the anchors 26 and 28 may be positioned and secured in the metal plate 24 of the catch basin 12. Each of bolts 20 and 22 are positioned in through-holes 42 and mated with a corresponding anchor 26 and 28 respectively.

The first purpose of the present invention is satisfied because the catch basin guard 10 is impervious to fluid, solids, animals and children; thus when a catch basin 12 is installed in a new construction site, the catch basin guard 10 prevents the catch basin 12 from filling and from being entered by children or animals. It is a most significant feature of the invention that the catch basin guard 10, in any circumstance, prevents mischievous children from accidentally or intentionally entering the catch basin 12, endangering their safety or even their lives.

Figure 5:
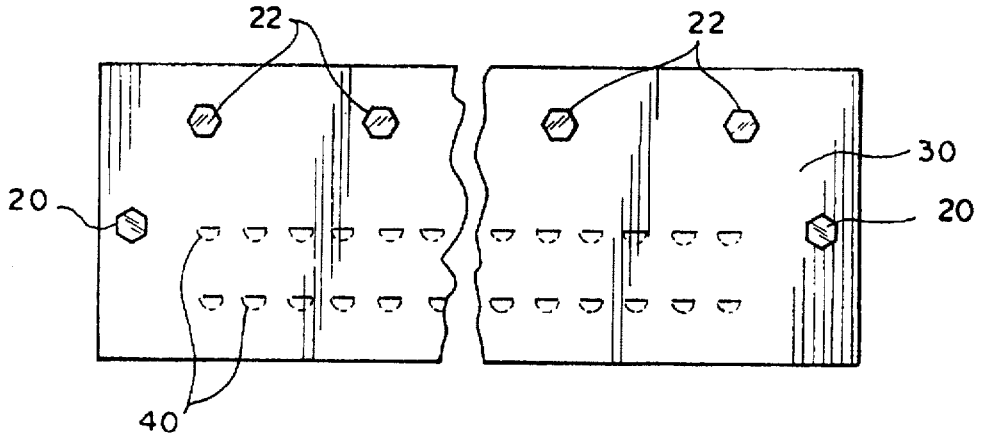
FIG. 5 is an elevational view of the face of the catch basin cover showing preformed punch-outs.
Figure 6:
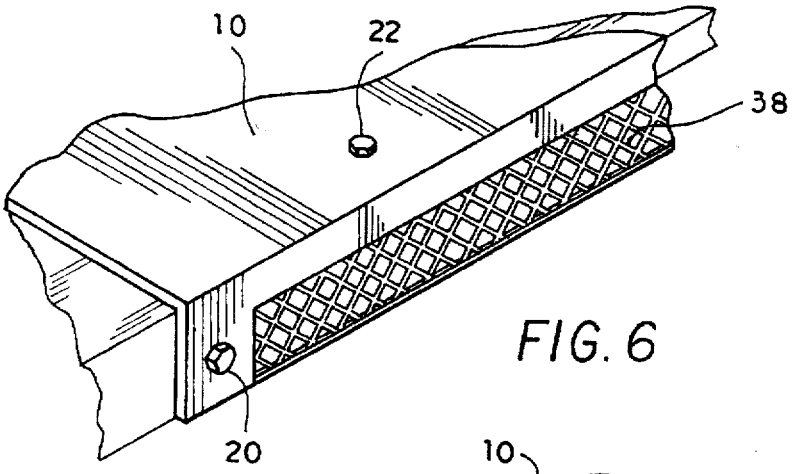
FIG. 6 is a perspective view of an alternative grill for the inlet of a catch basin.

Once the construction is near completion, or at least when the drain lines are coupled between the catch basins 12 and the main drain tubes, the catch basin guards 10 assume the function of allowing only fluid entry into the catch basin 12. Referring to FIG. 5, the face 30 of the catch basin guard 10 is shown with a plurality of punch-outs 40 that allow fluids to enter into the catch basin 12 without the passage of other non-fluid materials or animals or children into the catch basin 12. The punch-outs 40 are preferably, semi-circular indentations in the face 30 of the catch basin guard 10. When the appointed time during construction has been attained, the punch-outs 40 are easily forced into an opened position that allows water to pass into the catch basin 12, the guard then functioning as a weir. Alternately, the face 30 of the catch basin guard 10 may be provided with replaceable panel that allows an aesthetically appealing grill 38, as shown in FIG. 6, to be positioned across the inlet 18.

Figure 7:
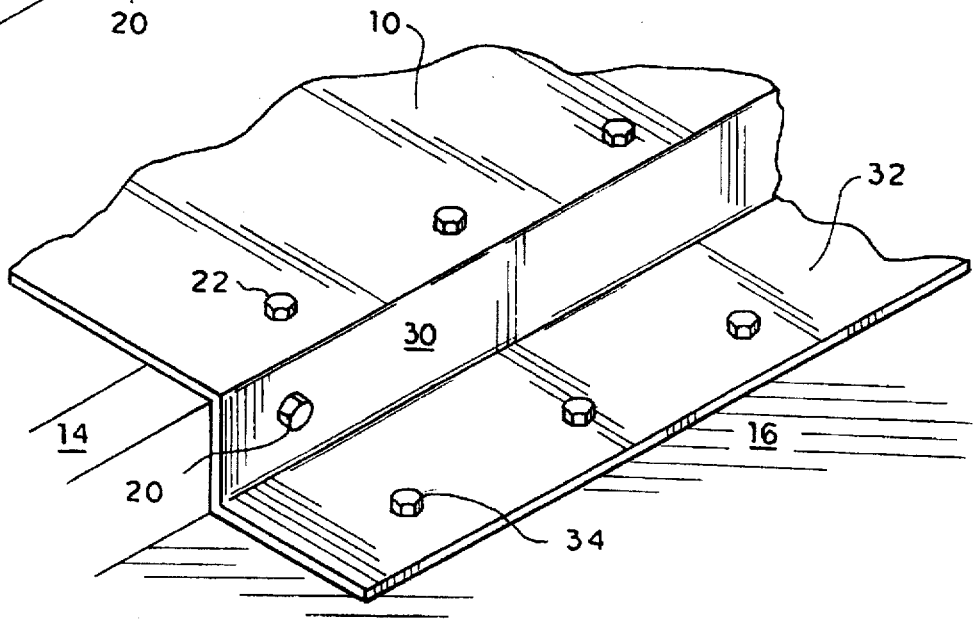
FIG. 7 is a perspective view of yet a further alternative embodiment of the invention.

Referring to FIG. 7, an alternative embodiment is shown. The face 30 of the catch basin guard 10 has an extension 32 extending from the bottom edge thereof outwardly over the roadway 16. The extension 32 performs the same non-ingression function as the face 30 of the catch basin guard 10 when the catch basin 12 has an inlet (such as inlet 18) in the surface of the roadway 16. The extension 32 is secured to the roadway 16 in like manner as the face 30 and the top of catch basin guard 10, via a plurality of bolts 34 which pass through holes (similarly as through-holes 42) and subsequently mate with anchors seated in the roadway 16 surface. The extension 32 is also provided with the punch-outs 40 or replaceable grill panel 38 for facilitation the fluid only entry into the catch basin 12.

The catch basin guard 10 of the present invention provides a necessary and extra amount of prevention of dangerous construction runoff. Also, the catch basin guard 10 of the present invention protects the environment. Most importantly, the invention protects the safety and lives of small children. Additional protection of the construction workers is encompassed by the catch basin guard 10 because disease carrying rodents are prevented from nesting in a catch basin before it has been permanently installed into the drain system.

It is to be understood that the present invention is not limited to the embodiments described above, but encompasses any and all embodiments within the scope of the following claims.

I claim:

1. A catch basin face cover for preventing unwanted entry into a catch basin of a curb, the catch basin having a curb wall with an upper portion and a lower portion offset in substantially parallel planes from one another and defining a drain entry therebetween, said catch basin face cover comprising:

a planar form having a plurality of throughbores, said planar form dimensioned to cover the drain entry;

a plurality of securing means for attaching said planar form to the curb wall, each of said plurality of securing means positioned in a different one of said plurality of throughbores; and a plurality of anchoring means for respectively receiving each one of said plurality of securing means, each of said plurality of securing means positioned in the curb wall and coupled to a different one of said plurality of anchoring means;

whereby said planar form covers the catch basin drain entry and said securing means coupled to said anchoring means holds said form over the drain entry.

2. The catch basin face cover for preventing unwanted entry into a catch basin according to claim 1, wherein said planar form is comprised of molded plastic.

3. The catch basin face cover for preventing unwanted entry into a catch basin according to claim 1, further including a plurality of punch-outs in said planar form for permitting fluid entry into the catch basin through said planar form.

4. The catch basin face cover for preventing unwanted entry into a catch basin according to claim 1, further including a first extension of said planar form, said first extension depending from said planar form at a substantially right angle forming an "L" configuration, whereby said first extension rests upon the upper portion of the curb wall and said planar form covers the drain entry.

5. The catch basin face cover for preventing unwanted entry into a catch basin according to claim 4, wherein said planar form and said extension are comprised of molded plastic.

6. The catch basin face cover for preventing unwanted entry into a catch basin according to claim 4, wherein said first extension defines a plurality of first extension throughbores, and further including a plurality of securing means for attaching said first extension to the curb wall, each of said plurality of securing means positioned in a different one of said plurality of first extension throughbores, and a plurality of anchoring means for respectively receiving each one of said plurality of securing means, each of said plurality of securing means positioned in the curb wall and coupled to a different one of said plurality of anchoring means.

7. The catch basin face cover for preventing unwanted entry into a catch basin according to claim 4, further including a second extension depending from said planar form at a substantially right angle forming a "Z" configuration, wherein said second extension defines a plurality of second extension throughbores, and further including a plurality of securing means for attaching said second extension to the curb wall, each of said plurality of securing means positioned in a different one of said plurality of second extension throughbores, and a plurality of anchoring means for respectively receiving each one of said plurality of securing means, each of said plurality of securing means positioned in the curb wall and coupled to a different one of said plurality of anchoring means, whereby said second extension rests upon the lower portion of the curb wall and said planar portion covers the drain entry.

8. The catch basin face cover for preventing unwanted entry into a catch basin according to claim 7, wherein said planar form includes a removable portion defining a grate.

9. A catch basin face cover for preventing unwanted entry into a catch basin of a curb, the catch basin having a curb wall with an upper portion and a lower portion offset in substantially parallel planes from one another and defining a drain entry therebetween, said catch basin face cover comprising:

a planar form having a plurality of throughbores, said planar form dimensioned to cover the drain entry;

a plurality of punch-outs in said planar form for permitting fluid entry into the catch basin through said planar form;

a first extension of said planar form and a second extension of said planar form, said first extension and said second extension depending from said planar form at substantially right angles forming an "Z" configuration;

wherein said planar form, said first extension and said second extension are comprised of molded plastic;

a plurality of securing means for attaching said planar form to the curb wall, each of said plurality of securing means positioned in a different one of said plurality of throughbores; and a plurality of anchoring means for respectively receiving each one of said plurality of securing means, each of said plurality of securing means positioned in the curb wall and coupled to a different one of said plurality of anchoring means;

whereby said first extension rests upon the upper portion of the curb wall, the second extension rests upon the lower portion of the curb wall and said planar form covers the drain entry.

10. The catch basin face cover for preventing unwanted entry into a catch basin according to claim 9, wherein said planar form includes a removable portion defining a grate.

11. The catch basin face cover for preventing unwanted entry into a catch basin according to claim 9, wherein said first extension defines a plurality of first extension throughbores, and further including a plurality of securing means for attaching said first extension to the curb wall, each of said plurality of securing means positioned in a different one of said plurality of first extension throughbores, and a plurality of anchoring means for respectively receiving each one of said plurality of securing means, each of said plurality of securing means positioned in the curb wall and coupled to a different one of said plurality of anchoring means.

12. The catch basin face cover for preventing unwanted entry into a catch basin according to claim 9, wherein said second extension defines a plurality of second extension throughbores, and further including a plurality of securing means for attaching said second extension to the curb wall, each of said plurality of securing means positioned in a different one of said plurality of second extension throughbores, and a plurality of anchoring means for respectively receiving each one of said plurality of securing means, each of said plurality of securing means positioned in the curb wall and coupled to a different one of said plurality of anchoring means, whereby said second extension rests upon the lower portion of the curb wall and said planar portion covers the drain entry.

13. A catch basin face cover for preventing unwanted entry into a catch basin of a curb, the catch basin having a curb wall with an upper portion and a lower portion offset in substantially parallel planes from one another and defining a drain entry therebetween, said catch basin face cover comprising:

a planar form dimensioned to cover the drain entry;

a plurality of punch-outs in said planar form for permitting fluid entry into the catch basin through said planar form;

a first extension of said planar form defining a plurality of first extension throughbores, and further including a plurality of securing means for attaching said first extension to the curb wall, each of said plurality of securing means positioned in a different one of said plurality of first extension throughbores, and a plurality of anchoring means for respectively receiving each one of said plurality of securing means, each of said plurality of securing means positioned in the curb wall and coupled to a different one of said plurality of anchoring means;

a second extension depending from said planar form at a substantially right angle, wherein said second extension defines a plurality of second extension throughbores, and further including a plurality of securing means for attaching said second extension to the curb wall, each of said plurality of securing means positioned in a different one of said plurality of second extension throughbores, and a plurality of anchoring means for respectively receiving each one of said plurality of securing means, each of said plurality of securing means positioned in the curb wall and coupled to a different one of said plurality of anchoring means;

wherein said planar form, said first extension and said second extension attach at substantially right angles forming a "Z" configuration and being comprised of molded plastic;

whereby said first extension rests upon the upper portion of the curb wall, the second extension rests upon the lower portion of the curb wall and said planar form covers the drain entry.

* * * * *